US005463967A

United States Patent [19]

Gielow et al.

[11] Patent Number: 5,463,967

[45] Date of Patent: Nov. 7, 1995

[54] STATIC MIXER DEVICE FOR IMPROVING HOMOGENEITY OF A CHARACTERISTIC OF A MIXTURE STREAM CREATED FROM FLUID STREAMS SEPARATELY ENTERING THE DEVICE

[75] Inventors: Robert L. Gielow; James C. Paul, both of Livonia, Mich.

[73] Assignee: Airflow Sciences Corporation, Livonia, Mich.

[21] Appl. No.: 278,164

[22] Filed: Jul. 21, 1994

[51] Int. Cl.[6] ..... F23K 3/02

[52] U.S. Cl. ..... 110/104 R; 454/261; 110/267; 110/263

[58] Field of Search ..... 454/261, 269; 110/227, 265, 303, 309, 267, 218, 104 R, 106, 263; 165/166

[56] References Cited

U.S. PATENT DOCUMENTS 2,400,617 4/1943 Wheller ..... 454/269 X

*Primary Examiner*—Denise L. Gromada
*Assistant Examiner*—Susanne C. Tinker
*Attorney, Agent, or Firm*—George L. Boller

[57] ABSTRACT

A static mixer device for mixing separate fluid streams entering the device in order to achieve a more uniform, or homogeneous, characteristic, such as temperature for example, in the resulting fluid mixture stream exiting the device. An exemplary embodiment of device comprises a series of parallel rectangular walls arranged in side-by-side, spaced apart relationship to form a series of rectangular spaces. The perimeters of these spaces are selectively closed to define respective first and second inlets and an outlet. The inlets sub-divide the respective entering fluid streams into sheet-like streams that are interleaved as they exit the device at the outlet. This interleaving of one stream with the other promotes increased homogeneity of the mixture stream in a shorter distance downstream of the confluence of the entrance streams. Turning vanes are provided for turning one of the sub-divided streams as it passes through the exemplary embodiment of mixer which is used as an air mixer in a coal-fired power plant.

20 Claims, 3 Drawing Sheets

STATIC MIXER DEVICE FOR IMPROVING HOMOGENEITY OF A CHARACTERISTIC OF A MIXTURE STREAM CREATED FROM FLUID STREAMS SEPARATELY ENTERING THE DEVICE

FIELD OF THE INVENTION

This invention relates to a static mixer device for accomplishing the mixing of separate fluid streams entering the device in order to achieve a more uniform, or homogeneous, characteristic, such as temperature for example, in the resulting mixture stream exiting the device.

BACKGROUND AND SUMMARY OF THE INVENTION

Certain power plants, such as those for generating electricity, use pulverized coal as a fuel. Typically, the pulverized coal is entrained in a temperature-controlled hot air stream to the combustor where the coal is burned to create hot gases that either drive a turbine generator directly or heat water to provide steam for driving a turbine-generator. The temperature of the hot air stream into which the pulverized coal is introduced is important, and one way of controlling the temperature is by tempering a relatively hotter air stream with a relatively colder tempering air stream. Dampers-are commonly employed as a means for adjusting the relative proportions of the relatively hotter and the relatively colder air streams for the purpose of attaining a desired average temperature for the tempered hot air stream into which the pulverized coal is to be introduced.

Even with such control, certain pre-existing coal-fired power plant installations have experienced problems, such as pre-ignition of the pulverized coal. Investigation of certain of these installations has now revealed that substantial temperature gradients can exist across the expanse of the tempered hot air stream into which the pulverized coal is introduced; and hence, it is speculated that pre-ignition of the pulverized coal is due to the presence of certain hot spots in the tempered hot air stream. While a gross introduction of relatively colder tempering air might avoid premature ignition of the pulverized coal, such a solution would inherently detract from process efficiency. Accordingly, it has now been realized that management of the air tempering process by only using the existing dampers to adjust the relative proportions of relatively hotter and relatively colder air streams that form the tempered hot air stream is apt to be a non-optimal solution, and possibly even an unsatisfactory one.

The present invention has provided a solution for this temperature gradient problem in an existing pulverized coal-fired power plant installation. More specifically, the invention has attained significant reductions in temperature gradient across the expanse of the tempered hot air stream in a way that provides temperatures conducive to optimizing process efficiency without creating hot spots that may cause pre-ignition of the fuel. Moreover, the air mixer device that accomplishes this result is a static structure that requires no moving parts and can be fit to both new and existing power plant installations.

Speaking generally and briefly by way of introduction with regard to the installation of the mixer device in a coal-fired power plant, one may define the present invention as a static air mixer device that comprises respective first and second inlets, or entrances, into which the relatively hotter and the relatively colder air streams are respectively introduced, channel means for sub-dividing each entrance stream into a number of sub-divided streams that pass through respective channels which are alternately side-by-side with respective channels through which the sub-divided streams of the other entrance stream pass, and respective outlets, or exits, from whence the side-by-side streams combine to form the tempered hot air stream across the expanse of which the temperature gradient is significantly reduced from that which was found to exist in the aforementioned power plant installations lacking such an air mixer device. The interleaved sub-divided streams accelerate the mixing process, resulting in the attainment of greater homogeneity within a shorter distance from the confluence of the relatively hotter and the relatively colder air streams, than was the case before the incorporation of the air mixer device. Moreover, because the device of the present invention can be fabricated by means of conventional fabrication techniques in an economical manner, it is well-suited for convenient and expeditious installation not only in pre-existing installations, but in new ones as well. With sufficiently strong construction and lacking moving parts, it can provide long, useful, maintenance-free service.

The coal-fired power plant described herein in detail represents one inventive example, and it is contemplated that principles of the invention will also enjoy other usage in other inventive examples. Hence, in its most comprehensive aspect, the present invention relates to a device for creating a mixture stream from two separate fluid streams where the objective of the mixer device is to create improved homogeneity in a particular characteristic of the resulting mixture, be such characteristic the temperature gradient across the resulting mixture, or some other characteristic or quality. Indeed, the constituents of each entering stream themselves do not even have to be homogeneous; for example, air itself is a mixture of various constituents, and it may even include certain entrained material like dust, pollen, or other particulates.

In one specific exemplary aspect of the invention as an air mixer device for a pulverized coal-fired power plant, an exemplary air mixer device creates a tempered hot air stream from a stream of relatively hotter air and a stream of relatively colder air. Pulverized coal is entrained with this tempered hot air stream to form a two-phase mixture stream that flows to a combustor where the coal is combined with other combustion air and burned to provide the thermal energy input to the power plant. The air mixer device creates the tempered hot air stream from the separate relatively hotter and relatively colder air streams that enter the device at respective inlets. Each entering stream is divided into a number of separate, parallel, side-by-side, spaced apart sub-divided streams, and as they pass through the device, the relatively hotter sub-divided streams and the relatively colder sub-divided streams are arranged alternately side-by-side so that as the two sets of sub-divided streams exit the device, the relatively hotter and relatively colder sub-divided streams are side-by-side. As these interleaved sub-divided streams mix upon exiting the device, they create a tempered hot air stream across the expanse of which the temperature gradient is significantly less than it was in the same installation without the mixer device. Hence, the mixer device has been shown to promote more uniform temperature over the expanse of the tempered hot air stream than in a pre-existing power plant that did not include the air mixer device, but instead relied merely on the use of dampers in the respective ducts conveying the respective relatively hotter and relatively colder air streams to the mixing zone. Other aspects of the fluid mixing device of the present invention extend beyond this one specific aspect of a pulverized coal-fired power plant.

Further features, advantages, and benefits of the invention, along with those already expressly mentioned, will be seen in the ensuing description and claims, which should be considered in conjunction with the accompanying drawings of a presently preferred embodiment of the invention, representing the best mode contemplated at this time in carrying out the invention.

DESCRIPTION OF THE PREFERRED EMBODIMENT

Figure 1:
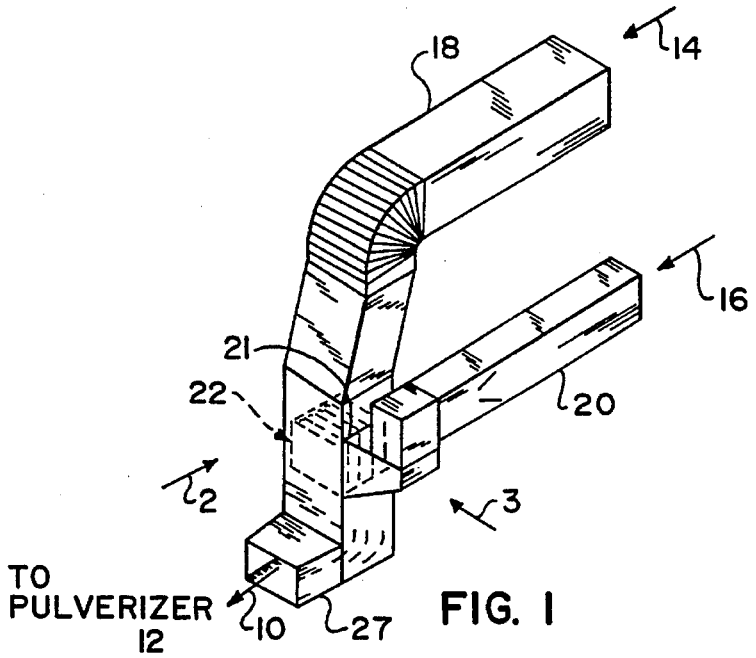
FIG. 1 is a perspective view, partly schematic, of a portion of a power plant that embodies the present invention.
Figure 2:
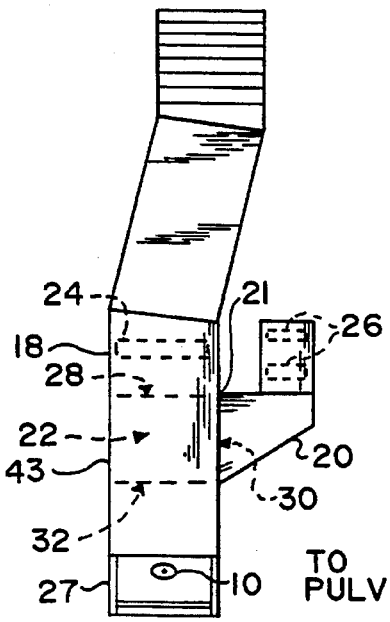
FIG. 2 is an elevational view in the direction of arrow 2 in FIG. 1.
Figure 3:
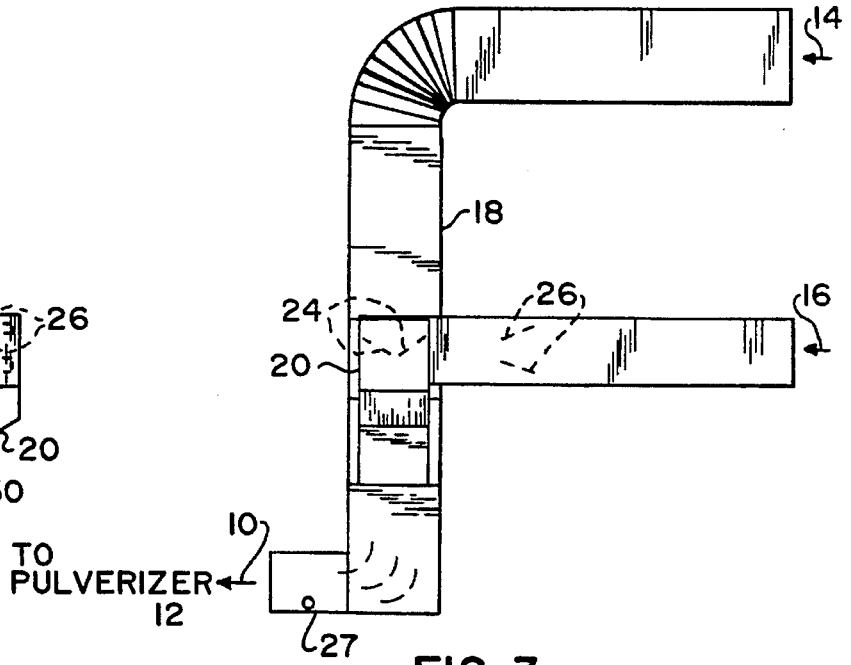
FIG. 3 is an elevational view in the direction of arrow 3 in FIG. 1.
Figure 4:
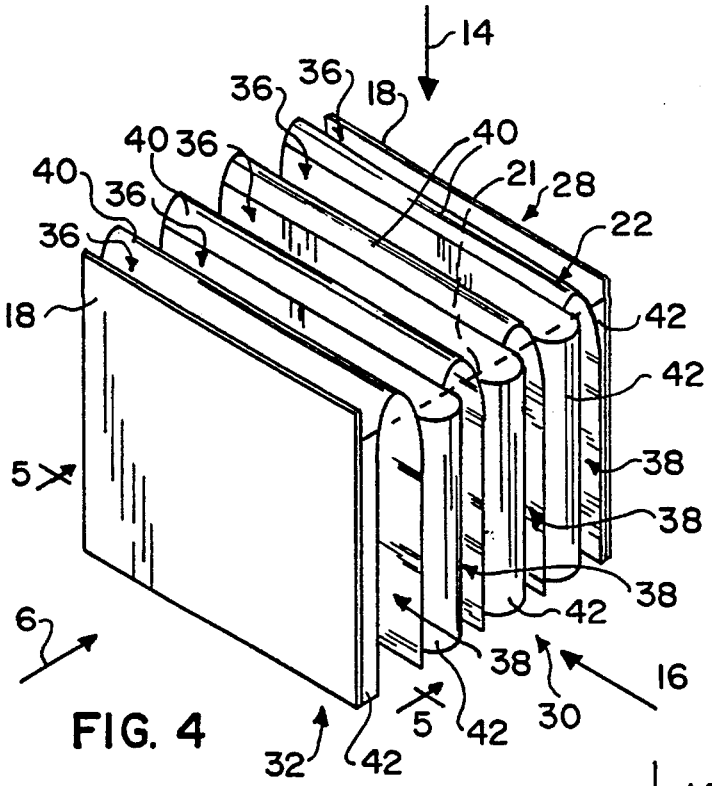
FIG. 4 is a perspective view of a fluid mixer device in accordance with the principles of the invention as used in the exemplary embodiment of FIGS. 1–3.

FIGS. 1–3 depict those portions of a certain pulverized coal-fired power plant that are relevant to the illustration of one particular embodiment of the present invention. The power plant comprises means for creating a tempered hot air stream 10 into which pulverized coal from a pulverizer 12 (the pulverizer not being specifically illustrated) is entrained to form a two-phase mixture stream that ultimately feeds a combustor (also not specifically illustrated) where the coal is burned. The tempered hot air stream 10 is created by tempering a stream of relatively hotter air 14 supplied through a duct, or conduit, 18 from a hot air source (not specifically illustrated) with a stream of relatively colder air 16 supplied through a duct, or conduit 20, from a cold air source (also not specifically illustrated).

In accordance with principles of the present invention, these two streams form separate inlet flows to a fluid (air, in this application) mixer device 22, and device 22 in turn provides tempered hot air stream 10 as an outlet flow in the form of a mixture of the relatively hotter and the relatively colder inlet air streams. This mixture passes from device 22 through a conduit 27 to the pulverizer. Duct 18 comprises dampers 24, and duct 20 comprises dampers 26, for setting relative proportions of the respective relatively hotter and relatively colder air streams that are introduced to mixer device 22.

What fluid mixer device 22 accomplishes is a distribution of the relatively hotter and the relatively colder air streams so that the temperature gradient across the expanse of the tempered hot air stream 10 to pulverizer 12 is minimized to a point where pre-combustion of the pulverized coal can be avoided without excessively lowering the average temperature of the stream.

Details of fluid mixer device 22 are presented in FIGS. 4–7. Fluid mixer device 22 comprises a first inlet 28 at which the stream of relatively hotter air 14 enters the device, a second inlet 30 at which the stream of relatively colder air 16 enters the device, and an outlet 32 from which the relatively hotter and colder air streams exit the device to form the tempered hot air stream 10 as a mixture of the two.

Fluid mixer device 22 comprises a series of parallel rectangular walls 34 that are arranged in side-by-side, spaced apart relationship to each other to form a series of rectangular spaces each lying between consecutive ones of said walls 34 and having a perimeter composed of four sides A, B, C, D. There are two groups of said spaces, a first group 36 and a second group 38. The first group of spaces 36 serves to form a first set of channels for conveying the relatively hotter air stream while the second group of spaces 38 serves to form a second set of channels for conveying the relatively colder air stream. The channels of one group alternate with those of the other group. Means 40 closes the second group of spaces 38 along the same first one of their four sides (side A) while leaving the first group of spaces 36 open along side A. Means 42 closes the first group of spaces 36 along the same second one of said four sides (side B) while leaving the spaces of said second group of spaces 38 open along side B. A wall 43, which may be the duct wall or a separate wall of the mixer device, closes the spaces of both of said groups 36, 38 of said spaces along the same third one (side C) of said four sides. The relatively hotter air stream 14 is communicated to side A where the spaces of said first group 36 are open to form inlet 28. The relatively colder air stream 16 is communicated to side B where the spaces of said second group 38 are open to form inlet 30. The spaces of both of said groups 36, 38 are left open along side D to form outlet 32 from both groups. Air turning vanes 44 are provided in said second group 38 of spaces to promote flow uniformity in the relatively colder air stream as it makes a ninety degree transition from its entrance at side B to its exit at side D. Vanes 44 seek to prevent the creation of recirculation zones that could otherwise create significant non-uniform flow as the stream passes through each of the spaces of group 38. The example illustrates three such vanes 44 in each space of group 38 that are profiled and shaped in the manner shown in FIGS. 5 and 6 to create four curved sub-channels E, F, G, H through each space of the second group 38. The reference numeral 21 in FIGS. 1 and 2 represents a corner edge in the ductwork where duct 20 intersects duct 18. Suitable provision must be made in the immediate vicinity of corner edge 21 to avoid premature cross mixing of the two entering streams. The corner edge 21 is shown in phantom in FIG. 4, and one way to avoid such cross mixing is closing, by any suitable means, those portions of the entrances to spaces 36 disposed to the lower right of edge 21 and those portions of the entrances to spaces 38 to the upper left of edge 21, as viewed in FIG. 4.

In use, the relatively hotter airflow approaching side A is, as it enters mixer device 22, split into a number of sub-divided flow streams equal to the number of spaces of the first group 36, and the relatively colder airflow approaching side B is, as it enters device 22, split into a number of sub-divided flow streams equal to the number of spaces of the second group 38. The sub-divided flow streams of relatively hotter air pass downward straight through the spaces of group 36. The sub-divided flows of relatively colder air make a ninety degree turn as they pass through the spaces of their group 38, being facilitated by the turning vanes 44 in making the transition from horizontal to vertical.

At side D, the sub-divided flows of both streams reunite with sheet-like streams of relatively hotter air alternating with sheet-like streams of relatively colder air as they leave device 22. A desired objective of the design of the illustrated embodiment is for the velocities of all interleaved sheet-like streams to be the same throughout as they exit the mixer device. As the tempered airflow proceeds downstream, the temperature gradient across its expanse is significantly less than it was in the same installation without the mixer device.

Figure 5:
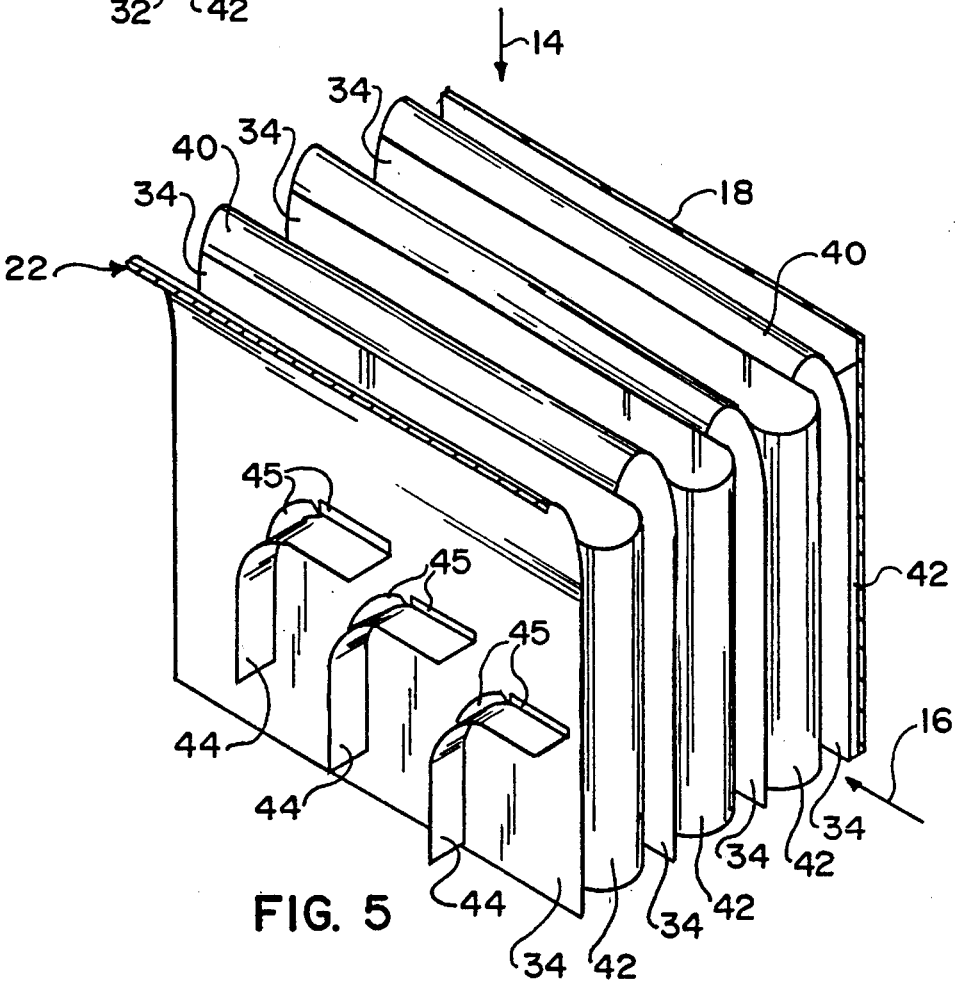
FIG. 5 is a perspective view of the fluid mixer in the same direction as FIG. 4, but on a larger scale and with a portion broken away for purposes of illustration of fluid turning vanes.
Figure 6:
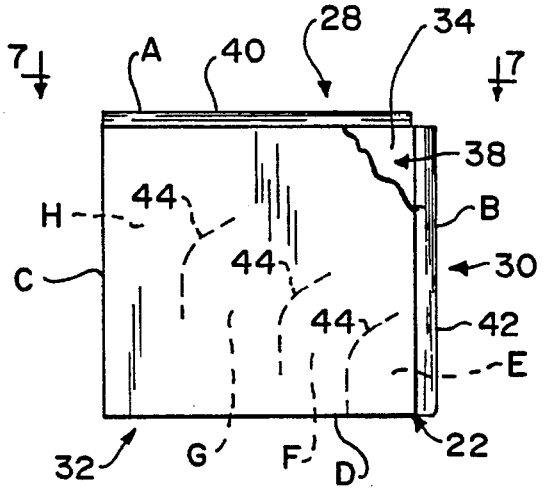
FIG. 6 is an elevational view in the direction of arrow 6 in FIG. 4, with a portion broken away for illustration.
Figure 7:
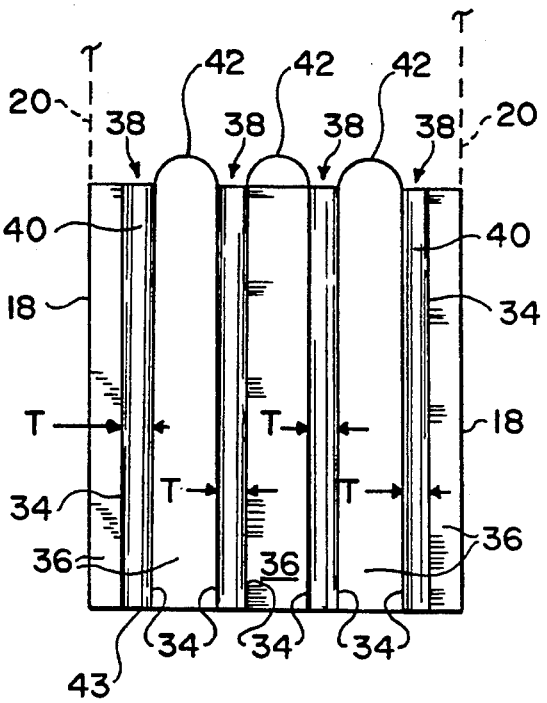
FIG. 7 is a top plan view in the direction of arrows 7—7 in FIG. 6, but slightly enlarged and rotated 90 degrees counterclockwise on the sheet, and including a portion of the ductwork for reference.

It can be seen from FIGS. 5 and 6 that vanes 44 comprise side flanges 45 that provide for their attachment to the adjacent wall 34. Actual constructional details of device 22 are largely a matter of convenience. Any given device 22 may be fabricated from suitable sheet metal parts assembled together. The fact that the illustrated closure means 40 and 42 are shown to be rounded so as to present convex surfaces to the respective entering streams is to facilitate the sub-dividing of the streams as they enter the device. If needed, stiffening, or reinforcing means may be incorporated into those portions of the device where stiffening or reinforcement is needed. Suitable measures may be taken for the actual splitting of the flows into sub-divided streams, as appropriate to any particular usage. In the example shown, each of the four spaces of group 38 has a thickness T that is thinner than that of each of the three central spaces of group 36 bounded on both sides by spaces of group 38. The thicknesses T are equal in this particular design. On the other hand, the thicknesses of the spaces of group 36 are not all identical. The two end spaces of group 36 happen to be thinner than the three identical central spaces of group 36. In other embodiments of the invention such relationships may be different.

Although the illustrated usage in a coal-fired power plant represents one aspect of the invention as a gas mixer (both inlet gases being air), inventive principles can be applied to other applications for improving homogeneity of one or more particular characteristics in a fluid mixture stream created from separate fluid streams entering the mixing device.

What is claimed is:

1. In a coal-fired power plant wherein pulverized coal is entrained with a temperature-controlled hot air stream to feed a combustor where combustion occurs, such hot air stream being created by tempering relatively hotter air with relatively colder air by mixing streams of such relatively hotter and colder air, the improvement which comprises an air mixer comprising a first inlet at which the stream of relatively hotter air enters the air mixer, a second inlet at which the stream of relatively colder air enters the air mixer, and an outlet from which the relatively hotter and colder air streams exit the air mixer to form the hot air stream, said air mixer comprising a series of parallel rectangular walls that are arranged in side-by-side, spaced apart relationship to each other to form a series of rectangular spaces each lying between consecutive ones of said walls and having a perimeter composed of four sides, means closing alternate ones of said spaces along the same first one of said four sides while leaving the remaining ones of said spaces open along said first of said four sides, said remaining ones of said spaces forming a first group of said spaces and said alternate ones of said spaces forming a second group of said spaces, means closing the spaces of said first group of said spaces along the same second one of said four sides while leaving the spaces of said second group of said spaces open along said second of said four sides, and means closing the spaces of both of said groups of said spaces along the same third one of said four sides, means for communicating said relatively hotter air stream to said first of said four sides of said spaces to cause said first inlet to be said first side of said spaces of said first group of said spaces, means for communicating said relatively colder air stream to said second of said four sides of said spaces to cause said second inlet to be said second side of said spaces of said second group of said spaces, means leaving the spaces of both of said groups of said spaces open along the same fourth one of said four sides to cause said outlet to be said fourth side of said spaces of both of said groups of said spaces, and air turning vanes in at least one of said groups of said spaces for turning a portion of the particular one of the relatively hotter and colder air streams passing through it.

2. The improvement set forth in claim 1 in which said second of said four sides of said spaces adjoins said first of said four sides of said spaces, said fourth of said four sides of said spaces is opposite said first of said four sides of said spaces, and said air turning vanes are in said second group of said spaces.

3. The improvement set forth in claim 2 in which air turning vanes define a series of curved air turning channels that run generally parallel as they curve.

4. The improvement set forth in claim 3 in which said air turning vanes stop short of said perimeter of said second group of spaces at both said second of said four sides and said fourth of said four sides.

5. The improvement set forth in claim 2 in which at least some of the spaces of said second group are narrower in thickness than are some of the spaces of said first group.

6. The improvement set forth in claim 1 in which said means closing alternate ones of said spaces along the same first one of said four sides comprises convex surfaces facing the relatively hotter air stream as it approaches said first inlet.

7. The improvement set forth in claim 1 in which said means closing the spaces of said first group along the same second one of said four sides comprises convex surfaces facing the relatively colder air stream as it approaches said second inlet.

8. The improvement set forth in claim 1 in which said means closing alternate ones of said spaces along the same first one of said four sides comprises convex surfaces facing the relatively hotter air stream as it approaches said first inlet, and said means closing the spaces of said first group along the same second one of said four sides comprises convex surfaces facing the relatively colder air stream as it approaches said second inlet.

9. In a coal-fired power plant wherein pulverized coal is entrained with a temperature-controlled hot air stream to feed a combustor where combustion occurs, such hot air stream being created by tempering relatively hotter air with relatively colder air by mixing streams of such relatively hotter and colder air, the improvement which comprises an air mixer comprising a first inlet at which the stream of relatively hotter air enters the air mixer, a second inlet at which the stream of relatively colder air enters the air mixer, and an outlet from which the relatively hotter and colder air streams exit the air mixer to form the hot air stream, said air mixer comprising a series of walls that are arranged in side-by-side, spaced apart relationship to each other to form a series of spaces each lying between consecutive ones of said walls, means closing alternate ones of said spaces at said first inlet while leaving the remaining ones of said spaces open at said first inlet, said remaining ones of said spaces forming a first group of said spaces and said alternate ones of said spaces forming a second group of said spaces, means closing the spaces of said first group of said spaces at said second inlet while leaving the spaces of said second group of said spaces open at said second inlet, and means closing the remainder of the spaces of both of said groups of said spaces except at said outlet where neither are closed, and-air turning vanes in at least one of said groups of said spaces for turning a portion of the particular one of the relatively hotter and colder air streams passing through it.

10. The improvement set forth in claim 9 in which said walls are in parallel relationship with each other.

11. A fluid mixer comprising a first inlet at which a first fluid stream enters the mixer, a second inlet at which a second fluid stream enters the mixer, and an outlet from which the two fluid streams exit the mixer to form a fluid mixture stream, said fluid mixer comprising a series of walls that are arranged in side-by-side, spaced apart relationship to each other to form a series of spaces each lying between consecutive ones of said walls and having a perimeter composed of plural sides, means closing alternate ones of said spaces along the same first one of said plural sides while leaving the remaining ones of said spaces open along said first of said plural sides to thereby form said first inlet, said remaining ones of said spaces forming a first group of said spaces and said alternate ones of said spaces forming a second group of said spaces, means closing the spaces of said first group of said spaces along the same second one of said plural sides while leaving the spaces of said second group of said spaces open along said second of said plural sides to thereby form said second inlet, and means closing the spaces of both of said groups of said spaces along the remainder of said plural sides except at one final side where the spaces of both of said groups of said spaces open along that one final side to thereby form said outlet.

12. A fluid mixer as set forth in claim 11 further including fluid turning vanes in at least one of said groups of said spaces for turning a portion of the particular one of the fluid streams passing through it.

13. A fluid mixer as set forth in claim 12 in which said fluid turning vanes are arranged to turn the particular fluid stream ninety degrees.

14. A fluid mixer as set forth in claim 11 in which said walls are parallel.

15. A fluid mixer as set forth in claim 14 in which said walls are rectangular in shape having four sides.

16. A fluid mixer as set forth in claim 15 in which said first inlet is along the same first one of four sides of said rectangular walls and said second inlet is along the same second one of said four sides of said rectangular walls, said first and said second sides being adjoining.

17. A fluid mixer as set forth in claim 11 in which said means closing alternate ones of said spaces along the same first one of said plural sides comprises convex surfaces facing the approaching fluid stream as it approaches said first inlet.

18. A fluid mixer as set forth in claim 11 in which said means closing the spaces of said first group of said spaces along the same second one of said plural sides comprises convex surfaces facing the approaching fluid stream as it approaches said second inlet.

19. A fluid mixer as set forth in claim 11 in which said means closing alternate ones of said spaces along the same first one of said plural sides comprises convex surfaces facing the particular fluid stream approaching said first inlet, and said means closing the spaces of said first group of said spaces along the same second one of said plural sides comprises convex surfaces facing the particular fluid stream approaching said second inlet.

20. A fluid mixer as set forth in claim 11 in which said first and second fluid streams are both gas streams.

* * * * *